US006570538B2

(12) United States Patent
Väisänen et al.

(10) Patent No.: US 6,570,538 B2
(45) Date of Patent: May 27, 2003

(54) SYMMETRICAL ANTENNA STRUCTURE AND A METHOD FOR ITS MANUFACTURE AS WELL AS AN EXPANSION CARD APPLYING THE ANTENNA STRUCTURE

(75) Inventors: Ari Väisänen, Ruutana (FI); Veijo Haapanen, Espoo (FI); Timo Kettunen, Tampere (FI)

(73) Assignee: Nokia Mobile Phones, Ltd., Espoo (FI)

( * ) Notice: Subject to any disclaimer, the term of this patent is extended or adjusted under 35 U.S.C. 154(b) by 87 days.

(21) Appl. No.: 09/851,746

(22) Filed: May 9, 2001

(65) Prior Publication Data

US 2001/0040528 A1 Nov. 15, 2001

(30) Foreign Application Priority Data

May 12, 2000 (FI) ..... 001136

(51) Int. Cl.[7] ..... H01Q 1/24
(52) U.S. Cl. ..... 343/702; 343/846
(58) Field of Search ..... 343/700 MS, 702, 343/767, 770, 828, 829, 830, 846, 848

(56) References Cited

U.S. PATENT DOCUMENTS

| | | | | |
|---|---|---|---|---|
| 4,584,585 A | | 4/1986 | Marko et al. | 343/702 |
| 4,646,101 A | | 2/1987 | Mathis | 343/878 |
| 5,365,246 A | * | 11/1994 | Rasinger et al. | 343/702 |
| 5,550,554 A | | 8/1996 | Erkocevic | 343/828 |
| 5,966,097 A | | 10/1999 | Fukasawa et al. | 343/700 |

FOREIGN PATENT DOCUMENTS

| | | |
|---|---|---|
| EP | 0400872 | 12/1990 |

* cited by examiner

*Primary Examiner*—Michael C. Wimer
(74) *Attorney, Agent, or Firm*—Perman & Green, LLP

(57) ABSTRACT

An antenna structure which comprises at least one active and at least one parasitic antenna conductor and which is arranged to be fitted on top of a planar electroconductive surface at a distance from said surface which is arranged to be used as a ground plane for said antenna structure, and which antenna structure comprises, arranged parallelly at a distance from each other, a first antenna conductor and a second antenna conductor which have an electrical length of approximately ¼ of the wavelength of the used frequency and which are parallel with said ground plane, and which comprise opposite first ends and opposite free second ends, wherein the antenna structure is equipped with symmetrical conductors for short-circuiting the first ends to said ground plane and a first conductor for coupling the supply to a desired point between the first end and a second end of the active antenna conductor. The antenna structure is symmetrically equipped with also a second conductor for coupling a short circuit to the corresponding point between the first end and the second end of the parasitic antenna conductor in such a way that in the rotated position of 180° of the antenna structure, the second conductor is, in turn, used as said supply and the first conductor is, in turn, used as said short circuit.

14 Claims, 4 Drawing Sheets

-PRIOR ART-

SYMMETRICAL ANTENNA STRUCTURE AND A METHOD FOR ITS MANUFACTURE AS WELL AS AN EXPANSION CARD APPLYING THE ANTENNA STRUCTURE

BACKGROUND OF THE INVENTION

1. Field of the Invention

The present invention relates to an antenna structure. The invention also relates to an expansion card. Furthermore, the invention relates to a method in the manufacture of an antenna structure.

2. Description of the Related Art

According to prior art, various electronic devices, such as portable personal computers (PC), are often equipped with an expansion card connection, to which a standard expansion card can be connected. The expansion card can contain the radio parts of a wireless communication device, including an antenna, wherein the PC can communicate with a communication network by means of this card-like wireless communication device. The expansion card may also constitute a network adapter e.g. for a wireless local area network (WLAN), wherein the card comprises the necessary electrical circuits e.g. for signal processing and for the transceiver. Said antennas are used for transmitting and receiving radio-frequency signals, and the signals are transferred between the radio part and the antenna by means of conductors and connectors.

Patent publication U.S. Pat. No. 5,966,097 presents a double antenna comprising an active antenna conductor which is a linear inverted-F antenna (IFA), and a parasitic straight antenna conductor. Each antenna conductor consists of conductors which are arranged in parallel on a ground plane and coupled at one end to this ground plane. The active antenna conductor is further coupled to a radio frequency (RF) feed point at a certain point. The wire-like antenna elements can be fixed and supported to the printed circuit board (PCB) used as the ground plane in different ways, of which examples are presented in patent publications U.S. Pat. No. 4,646,101 and U.S. Pat. No. 4,584,585. The plate-like elements can also be implemented with pieces cut and bent from a conductive metal sheet, fixed onto the PCB board where the ground plane is formed for example with a large conductive coating. One fixing method is also presented in patent publication U.S. Pat. No. 5,550,554.

In the assembly, the different antenna conductors of the double antenna are separately placed onto the circuit board, wherein the elements must be separated from each other at least for sorting. Furthermore, it must be possible to place the antenna conductor in the right direction onto the circuit board. Moreover, it should be possible to place the antenna conductors in a correct position to direct that end of the conductor which is connected to the ground plane in the desired direction. When the double antenna is used in a diversity antenna, at least two pieces of each antenna conductor will be required. In the diversity antenna, identical antennas are often used as mirror images of each other, wherein the possible positions of each conductor vary.

One problem is often the fact that antenna conductors of similar type differ from each other in the way of fixing them onto the circuit board. Thus, a diversity antenna consisting of two double antennas comprises a total of four different antenna conductors, whose positioning at the right place and handling must be taken care of. Patent publication U.S. Pat. No. 5,966,097 presents one prior art alternative, in which the antenna conductors are placed in the same support element.

The positioning of also this support element must be taken care of as presented above, particularly in a diversity antenna, but the antenna conductors are readily in the correct position in relation to each other.

If the antenna elements are installed separately, changes and errors in the placement cause variations in the dimensions of the antenna structure which also have a harmful effect on the electrical operation.

SUMMARY OF THE INVENTION

It is an aim of the invention to eliminate the above-mentioned drawbacks related to the complication of the assembly and fixing of the antenna conductors, the slowness of the assembly steps, and the large number of various antenna elements. The invention relates to a double antenna whose electrical operation corresponds to the solution in patent publication U.S. Pat. No. 5,966,097, as well as to an optimized diversity antenna consisting of two said double antennas.

The main principle of the invention is the symmetry of the antenna structure and the conductors in view of the assembly, wherein the different position alternatives are reduced or totally eliminated and the assembly becomes easier and faster. One essential idea is also to place the symmetrical conductors of the double antenna in a common support frame which is further fixed onto the circuit board of a wireless communication device, an expansion card. The total manufacturing time of the expansion card can be reduced, since the antenna conductors do not need to be installed separately, and the way of installation resembles the way of assembling also the other components to be fixed onto the surface of the circuit board. Integration of the conductors related to the antenna in the same support frame provides advantages particularly in antennas, such as diversity antennas, which comprise several antennas or antenna conductors to be installed in different positions.

If the support element is for example a multi-layer or double-sided circuit board, the antenna can be manufactured by methods known as such by means of the circuit board material used as a dielectric, and strip conductors. A particular advantage is achieved in that variations in the dimensions caused by assembly of the antenna elements can be reduced by measuring accuracy of the circuit boards, wherein the operation of the antenna is more reliable.

Furthermore, an essential principle of the invention is to place the diversity antenna card in an optimized way in a housing for the expansion. Spurious signals emitted by processors and electrical circuits in electronic devices interfere with the operation of the antenna. When placed in a part used as an extension of the expansion card, the antenna structure can be taken out of the connection and further from the device.

BRIEF DESCRIPTION OF THE DRAWINGS

In the following, the invention will be described in more detail with reference to the appended drawings, in which.

DETAILED DESCRIPTION OF THE INVENTION

Figure 1:
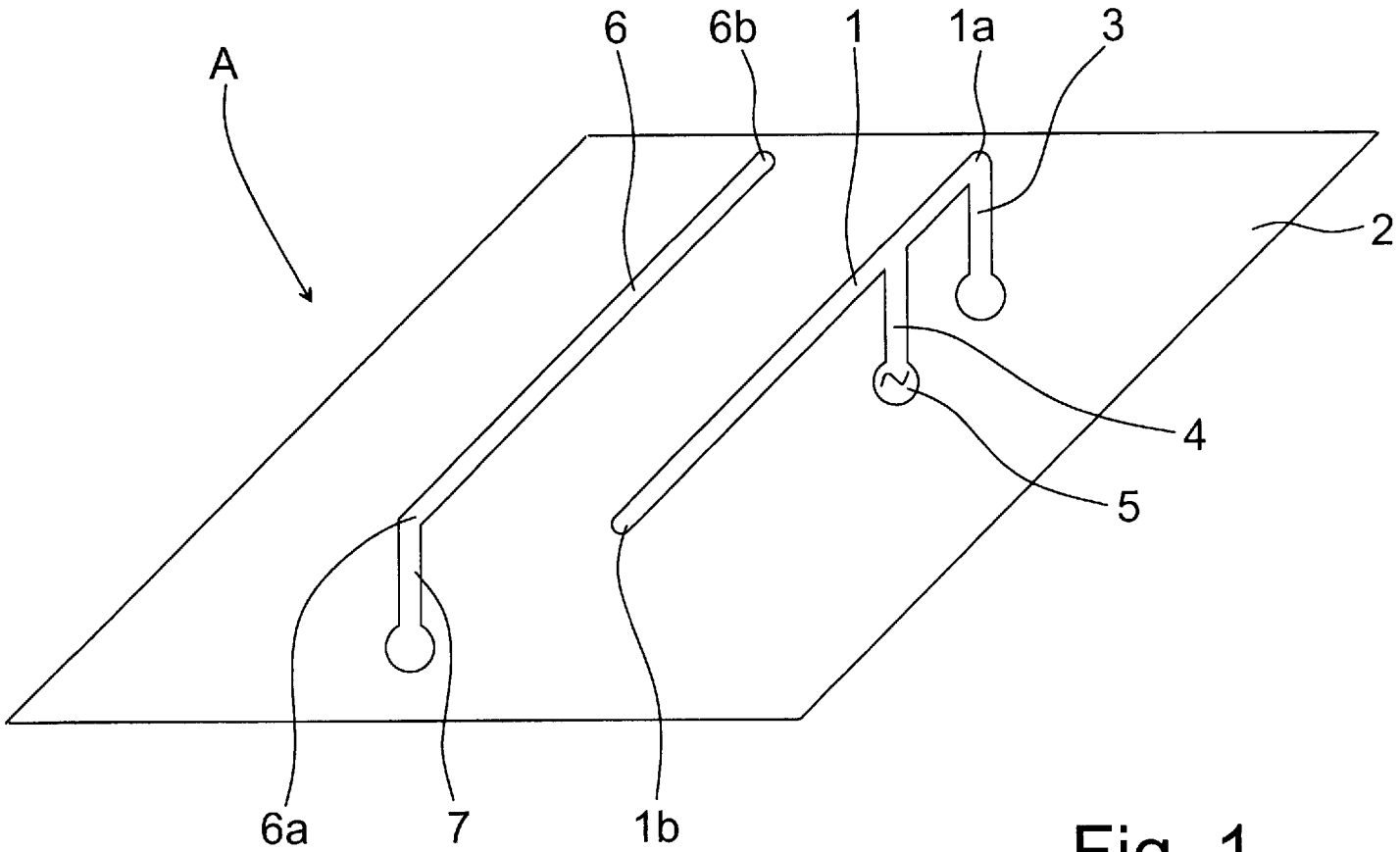
FIG. 1 shows an antenna structure according to prior art in a principle view.

With reference to FIG. 1, a prior art antenna structure A comprises a linear antenna conductor 1 which is in this case used as an active antenna conductor and an IFA element. The length of the conductor is approximately ¼ of the used wavelength. The conductor 1 is substantially parallel with a planar ground plane 2, from which it is arranged at a desired distance. The aim is to maximize the distance to increase the used frequency range, efficiency and antenna gain. The conductor 1 is short-circuited at its first end 1*a* with a conductor 3 to the ground plane 2, and it also comprises a second end 1*b* which is free. Further, a first conductor 4 is coupled to the conductor 1 at a desired point between the ends 1*a*, 1*b*. The first conductor 4 is also coupled to a supply point 5 which is normally placed on the circuit board and on the same plane with the ground plane 2. The conductor 4 is used for supplying radio frequency power to the antenna.

The antenna structure A further comprises an adjacent linear antenna conductor 6 which is in this case used as a parasitic antenna conductor. An electrical coupling is formed between the antenna conductors 1 and 6 when radio frequency energy is supplied to the conductor 1. To achieve an optimal coupling, the conductor 6 is short-circuited with a conductor 7 to the ground plane 2 at its first end 6*a* which is opposite to the end 1*a*. The second end 6*b* is free.

Figure 2:
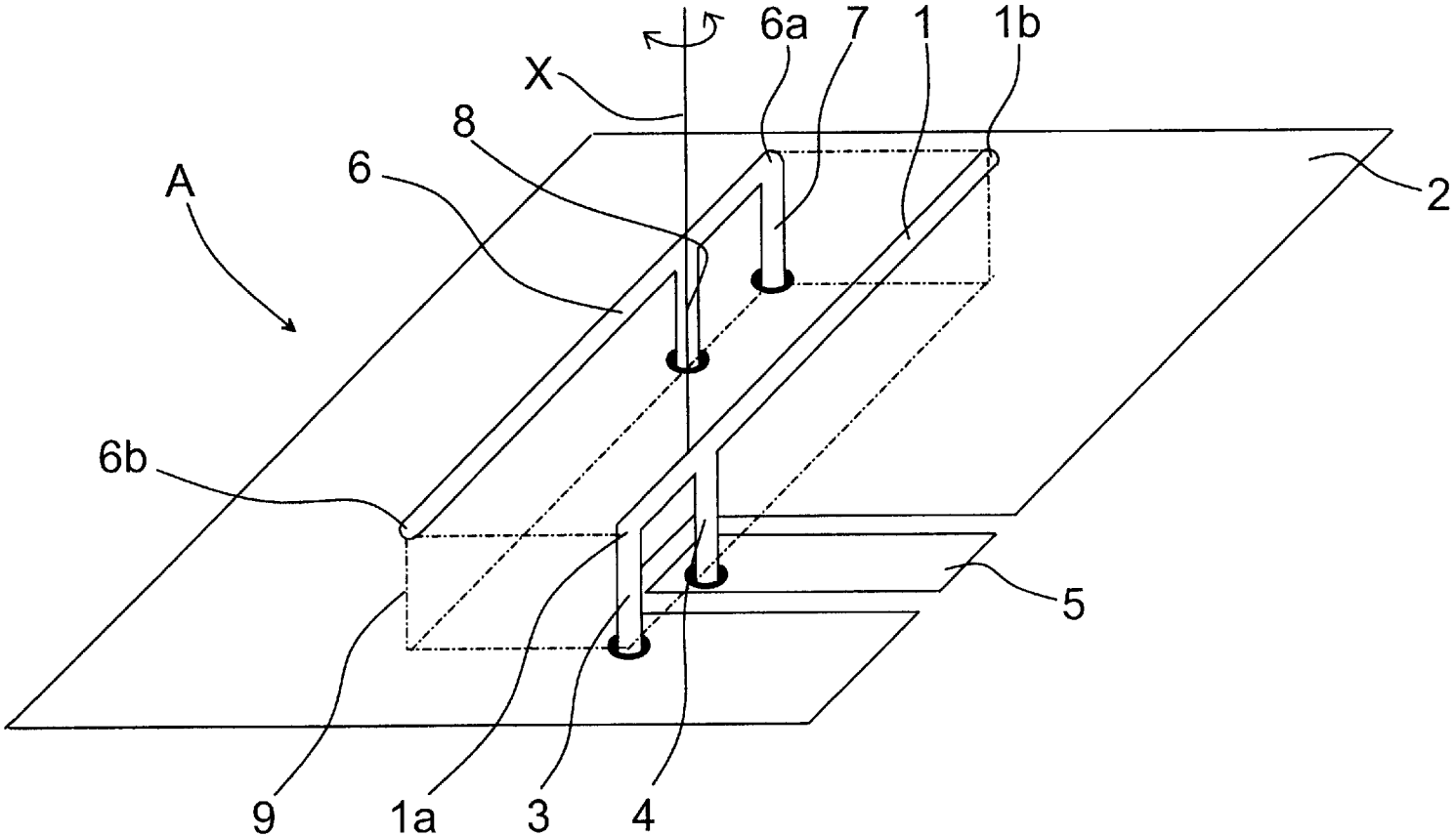
FIG. 2 shows an advantageous embodiment of the invention in a principle view.

FIG. 2 illustrates the antenna structure A according to the invention. The antenna structure A must operate in a corresponding way electrically, when the position of the conductors 1, 3, 4, 6, and 7 is rotated 180°. Thus, e.g. the antenna pattern of the antenna remains similarly directed diagonally upwards. In the rotation, the functions of the antenna conductors 1 and 6 are reversed. The rotation is made around such an axis X which extends between the conductors 1 and 6 in a direction perpendicular to the ground plane 2. In the rotation, the conductors 3 and 7 exchange their point of contact to the ground plane 2. According to the invention, the antenna structure A now comprises also a second conductor 8 which is coupled, between the conductor 6 and the ground plane 2, symmetrically at a point corresponding to the conductor 4. Said point is located between the ends 6*a*, 6*b*. In the rotation, the conductors 4 and 8 exchange their contact points on the ground plane 2 and at point 5. The conductor 4 or 8 coupled to the ground plane 2 will always couple the antenna conductor on the same side to the ground plane 2.

FIG. 2 illustrates, with broken lines, a frame part 9 in which the different conductors are fixed or formed for the assembly. The frame part 9 is for example a printed circuit board in which the different conductors are formed by strip-like copper conductors by methods known as such. In the presented embodiment, the conductors 1 and 6 are straight conductors, but a physically shorter antenna structure is achieved by a meander shape of the conductors, wherein the electrical length of the antenna conductor corresponds to a quarter of the wavelength used. The meander shape is a conductor structure known as such, resembling a rectangular wave. The physical length of the straight conductor substantially corresponds to a quarter of the wavelength. Also other shapes of the antenna conductor are possible, e.g. knee bends, as long as the shapes of the conductors 1 and 6 correspond to each other symmetrically, wherein the turning position is insignificant in connection with the assembly. The ground plane 2 is normally implemented on the top surface of the circuit board where the antenna structure is composed and fixed by automatical means known as such. In view of optimizing the manufacture, the circuit board is preferably an SMD board in which surface mount technology (SMT) of components is applied. The antenna structure can also be implemented with 3D molded interconnect devices (MID) technology applying high-temperature thermoplastics integrated with conductive surfaces and conductive patterns by metal coatings.

Figure 3:
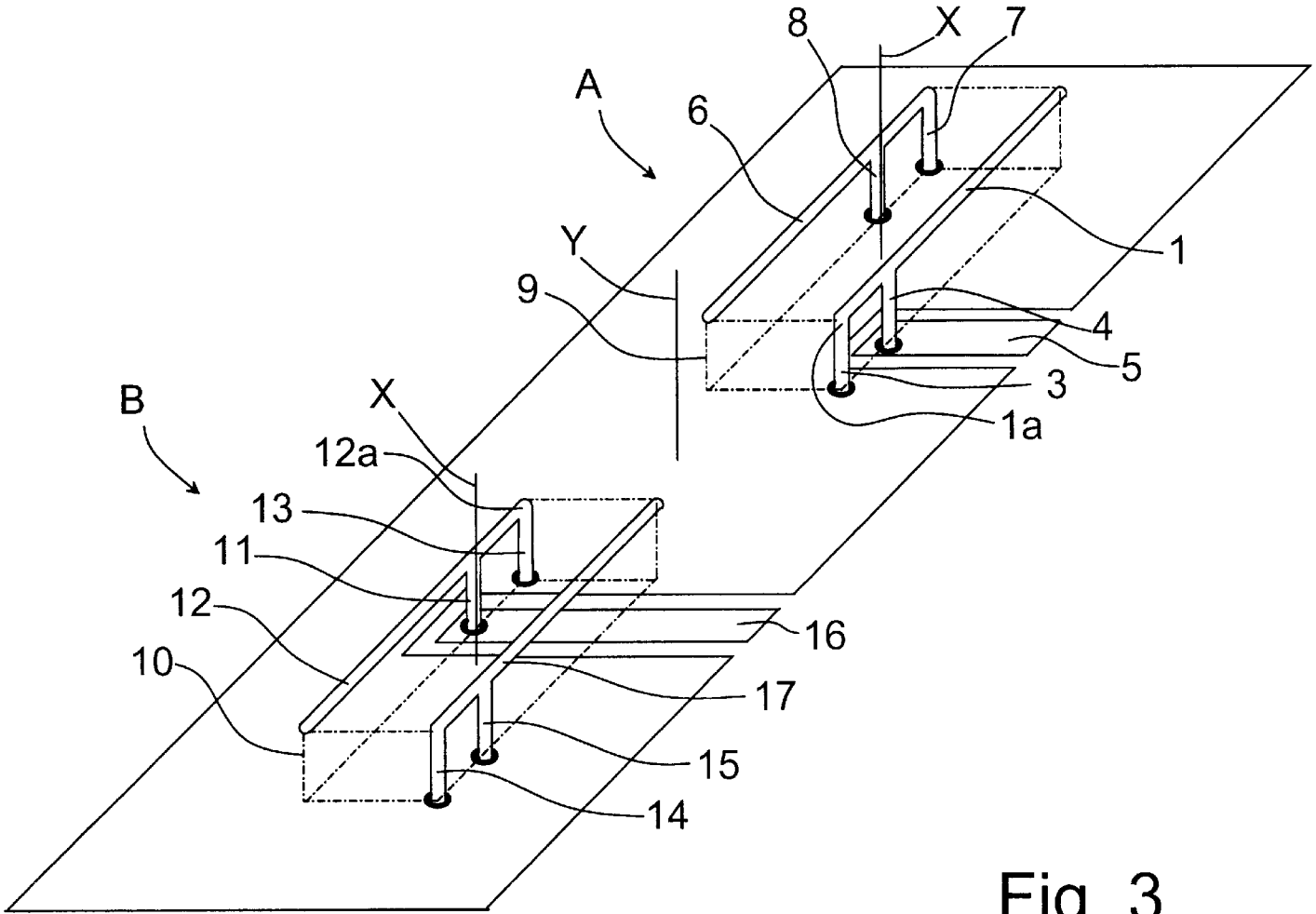
FIG. 3 shows a second advantageous embodiment of the invention in a principle view.

FIG. 3 shows a diversity antenna comprising two antenna structures A and B according to FIG. 2. The conductors of the antenna structure A are placed in a frame part 9, and the conductors of the antenna structure B are placed by a corresponding technique to a frame part 10. The antenna structures A and B are tuned to operate at the same frequency. In receiving, it is possible to select electrically the antenna to be used, wherein it is possible to avoid attenuation of the received signal, caused by multipath fading. In view of optimization, the antenna structures A and B are placed as far from each other as possible, wherein the functional properties are improved. The functions related to said diversity are known as such to anyone skilled in the art, wherein their more detailed description is rendered unnecessary.

FIG. 3 shows the antenna structures A and B placed one after the other in an optimal position in view of isolation and antenna gain, when also the first conductors 4 and 11 are closer to those ends 1*a* and 12*a* of the conductors 1 and 12 which are closest to each other. The antennas are thus coupled more weakly to each other. An antenna conductor 17 corresponds to the antenna conductor 6. A conductor 13 corresponds to the conductor 3, a conductor 14 corresponds to the conductor 7, and a conductor 15 corresponds to the conductor 8. A contact point 16 corresponds to the point 5, but the point 16 is extended further here. It is obvious that the shapes of the contacts 5 and 16 can vary.

According to the invention, the antenna structure B is placed in the frame part 10 which corresponds in its structure to the frame part 9, wherein they can be interchanged, when the position of each is also rotated 180° around a vertical axis. Thus, it is only necessary to manufacture only either of the frame parts 9 or 10 with its antenna structure, and either of the rotating positions will be correct in view of the assembly. Thus, according to an advantageous embodiment of the invention, the frame parts 9 and 10 are connected to the same integrated, elongated frame part, wherein the number of frame parts to the assembled is halved. According to the invention, also in this case the structure is symmetrical, wherein the position can be rotated 180° around a vertical axis Y without affecting the electrical operation.

Figure 4:
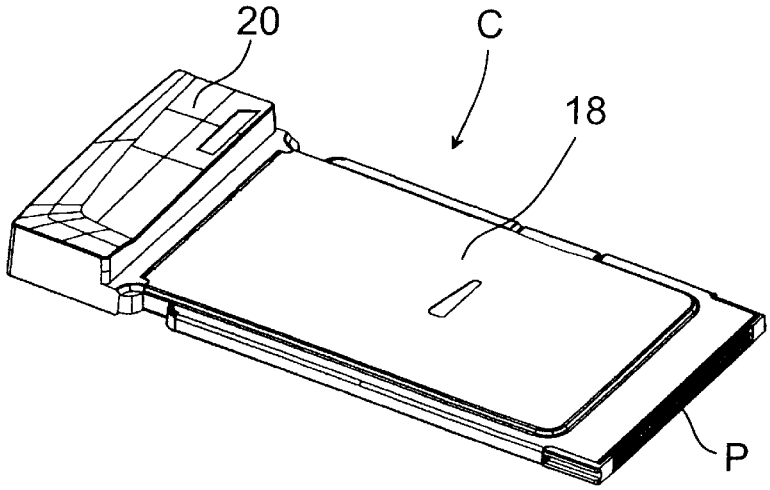
FIG. 4 shows an expansion card in which the antenna structure according to the invention is applied, in a perspective view.
Figure 5:
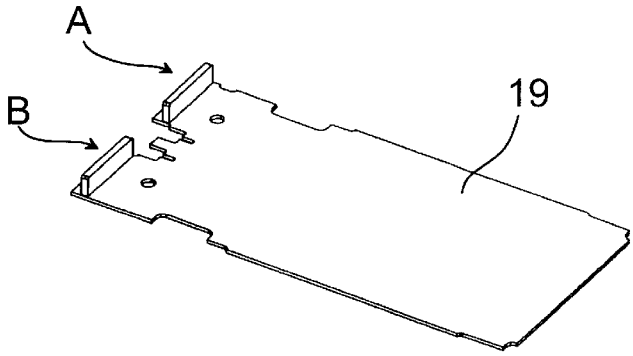
FIG. 5 shows, in a perspective view, a circuit board to be placed in an expansion card of FIG. 4, equipped with a diversity antenna according to the invention.

FIG. 4 shows an expansion card according to an advantageous embodiment, for which the application is particularly well suited. The card part 18 of the card C is a PC card complying with the PCMCIA standard. PC cards are designed to be inserted fully inside a PC by a movement in the direction of the longitudinal axis of the PC card, but so-called extended PC cards can be even 40 mm longer than ordinary PC cards. A PC card is equipped with a 68-pin connector P complying with the PCMCIA standard. The connector P is normally fixed to a circuit board 19 placed inside the card C and shown in FIG. 5, and which is also equipped with the components (such as integrated circuit, IC) and wirings necessary for the functions of the PC card for the transmission of electrical signals between the connectors and the components. The components comprise a transceiver for processing signals which are transmitted and received at radio frequency in a wireless manner by means of an antenna. The card C, normally a circuit board, is also equipped with the wirings and electrical circuits for transmitting signals between the transceiver and the electronic device. The operation of the other electrical circuits and the transmission of signals are known as such for anyone skilled in the art, wherein a more detailed description will not be necessary.

The cover and bottom structures of the card part 18 are normally formed of a thin sheet made of metal and having substantially a standard thickness. The connector P and the frame structure of the card are normally at least partly of plastic, such as polyethylene (PE). The structure and dimensions of the card part can vary even to a great extent within the scope of the invention.

The card C comprises a cover part 20 fixed at the end of the card part 18, equipped also with the antenna structures. The cover part 20 is preferably placed outside the slot-like expansion card connection. The cover part 20 comprises a cover structure and a bottom structure, but its shape and dimensions can also differ from those presented. The antenna structures are placed in the cover part 20. The ground plane is preferably placed on the side of the bottom structure, underneath the antenna structure, to direct the radiation pattern of the antenna in the normal use position of the card C upwards towards a base station fixed e.g. on a wall. In the cover part 20, said antennas can be placed considerably more freely and spaciously.

Figure 6:
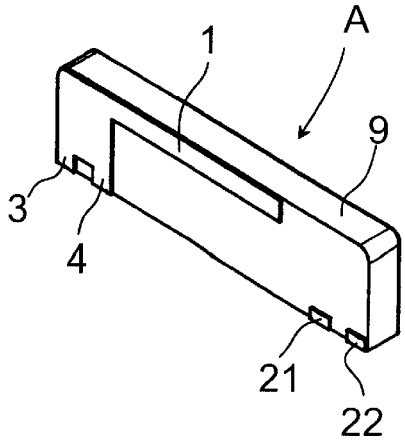
FIG. 6 shows a third advantageous embodiment of the invention in a perspective view.

FIG. 6 shows an advantageous embodiment of the antenna structure. The antenna structure A comprises a circuit board 9 used as a dielectric which is erected and used as the above-mentioned frame part. The necessary conductive patterns on the vertical surfaces of the circuit board are formed by means of strip conductors made of copper. The circuit board can also be multi-layered. The reference numerals and components of FIG. 6 correspond to those of FIG. 2. The circuit board 9 is longer than the antenna conductors, and the opposite surface of the frame part 9 has a corresponding appearance. The antenna conductors are fitted next to each other and slightly displaced in relation to each other in the longitudinal direction, wherein the free ends are shifted closer to each other. The electrical operation of the antenna is tuned by fine adjustment of the dimensions to operate at a desired frequency. The frame part 9 is composed on top of the circuit board and fixed by soldering with copper strips 21, 22 at the other end and the lower edge of the frame part 9. There are corresponding strips in the diagonal corner of the frame part 9.

The earth conductor 3 and the first conductor 4 are connected at their almost whole length from up downwards, forming a substantially uniform conductor surface. The conductors are separate at their lower parts, at which they are solderded to the corresponding contacts of the circuit board. The uniformity of the conductors is considered in the determination of their joint width and in the optimization of the electrical operation of the antenna conductor. The antenna is fitted to the other electrical circuits of the device by selecting the feed point of the supply conductor.

The symmetry and optimization of the operation according to the invention can also be implemented in a dual band antenna device. Thus, the antenna conductors at ¼ of the wavelength are divided into two conductors with different lengths, for example to a meander conductor and a straight conductor.

It is obvious that the invention is not limited solely to the advantageous embodiments presented above but it can be varied within the scope of the claims.

What is claimed is:

1. An antenna structure, comprising at least one active and at least one parasitic antenna conductor and arranged to be fitted on top of a planar electroconductive surface at a distance from said surface which is arranged to operate as a ground plane for said antenna structure, and which antenna structure comprises, arranged parallelly at a distance from each other, a first antenna conductor and a second antenna conductor which have an electrical length of approximately ¼ of the wavelength of the used frequency and which are substantially parallel with said ground plane, and which comprise opposite first ends and opposite free second ends, wherein the antenna structure is further equipped with symmetrical conductors at the first ends for short-circuiting the first ends to said ground plane and a first conductor for coupling a supply of radio frequency energy to a desired point between a first end and a second end of the active antenna conductor, wherein the antenna structure also includes a second conductor symmetrical to the first conductor for coupling a short circuit to the ground plane at a corresponding point between a first end and a second end of the parasitic antenna conductor in such a way that when the antenna structure is rotated 180°, the second conductor is, in turn, used as said supply and the first conductor is, in turn, used as said short circuit.

2. An antenna structure according to claim 1, wherein the antenna structure is an integrated element for assembly in a frame part.

3. An antenna structure according to claim 2, wherein the integrated element comprises a circuit board on which said conductors are formed by means of strip conductors made of copper.

4. An antenna structure according to claim 3, wherein said strip conductors are substantially perpendicular to said ground plane.

5. An antenna structure according to claim 3, wherein the circuit board is a double-sided circuit board whose each side is equipped with said antenna conductor, said short circuit and said supply.

6. An antenna structure according to claim 3, wherein the circuit board is also equipped with soldering surfaces by means of copper conductors for fixing said circuit board by soldering to said ground plane.

7. An antenna structure according to claim 1, wherein a shape of the active and parasitic antenna conductors are meander or straight.

8. An antenna structure according to claim 1, wherein it is also equipped with two identical antenna structures one after the other for forming a diversity antenna and for installing the same also in a position rotated 180°, wherein the free ends of the active antenna conductors are placed outermost in the structure.

9. An antenna structure according to claim 1, wherein said supply conductor and said short-circuit conductor are strip conductors and are connected to each other at the ends on the side of the antenna conductor and separated from each other at the ends on the side of the ground plane.

10. A longitudinal expansion card, comprising a card part which is arranged to be inserted preferably completely in the expansion card connection of an electronic device, a housing part to be fixed at a distance from said card part, which is at least partly arranged to extend outside said connection, a circuit board fitted inside said card part and said housing part, and an antenna structure which comprises at least one active and at least one parasitic antenna conductor and which is arranged to be fitted on top of a planar electroconductive surface, at a distance from said surface, which is arranged to be used as the ground plane of said antenna structure, and which antenna structure comprises, fitted substantially parallelly at a distance from each other, a first antenna conductor and a second antenna conductor, which have an electrical length of approximately ¼ of the wavelength of the used frequency and which are parallel with said ground plane, and which comprise opposite first ends and opposite free second ends, wherein the antenna structure is further equipped with symmetrical conductors at the first ends for short-circuiting the first ends to said ground plane and a first conductor for coupling a supply of radio frequency energy to a desired point between a first end and a second end of the active antenna conductor, wherein the antenna structure also includes a second conductor symmetrical to the first conductor for coupling a short circuit to the corresponding point between a first end and a second end of the parasitic antenna conductor in such a way that when the antenna structure is rotated 180°, the second conductor is, in turn, used as said supply and the first conductor is, in turn, used as said short circuit.

11. An expansion card according to claim 10, wherein the antenna structure is an integrated element for assembly in a frame part.

12. An expansion card according to claim 11, wherein the integrated element comprises a circuit board on which said conductors are formed by means of strip conductors made of copper.

13. A method in the manufacture of an antenna structure which comprises at least one active and at least one parasitic antenna conductor and which is arranged to operate as a ground plane for said antenna structure, and which antenna structure comprises, arranged substantially parallelly at a distance from each other, a first antenna conductor and a second antenna conductor which have an electrical length of approximately ¼ of the wavelength of the used frequency and which are parallel with said ground plane, and which comprise opposite first ends and opposite free second ends, wherein equipping the antenna structure further with symmetrical conductors at the first ends for short-circuiting the first ends to said ground plane and a first conductor for coupling a supply of radio frequency energy to a desired point between a first end and a second end of the active antenna conductor, equipping the antenna structure with a second conductor symmetrically to the first conductor for coupling a short circuit to the ground plane a corresponding point between a first end and a second end of the parasitic antenna conductor in such a way that when the antenna structure is rotated 180° the second conductor is, in turn, used as said supply and the first conductor is, in turn, used as said short circuit.

14. A method according to claim 13, wherein the antenna structure is formed as an integrated element for assembly into a frame.

* * * * *

UNITED STATES PATENT AND TRADEMARK OFFICE

CERTIFICATE OF CORRECTION

PATENT NO. : 6,570,538 B2
DATED : May 27, 2003
INVENTOR(S) : Vaisanen et al.

It is certified that error appears in the above-identified patent and that said Letters Patent is hereby corrected as shown below:

Title page,
Item [30], Foreign Application Priority Data, please change to:
-- May 12, 2000 (FI) ..... 20001136 --

Signed and Sealed this

Thirtieth Day of September, 2003

JAMES E. ROGAN
*Director of the United States Patent and Trademark Office*